United States Patent [19]

Rosner

[11] 4,439,970

[45] Apr. 3, 1984

[54] RETAINER FOR THE ATTACHMENT OF PANELING ELEMENTS, PANELING STRUCTURE PRODUCED BY USING THE RETAINER AND PANELING STRIP SUITABLE FOR USE OF THE RETAINER

[76] Inventor: Wolfgang Rosner, Josephsburgstr. 73a, D-8000 München 80, Fed. Rep. of Germany

[21] Appl. No.: 224,038

[22] Filed: Jan. 12, 1981

[30] Foreign Application Priority Data

Jan. 16, 1980 [DE] Fed. Rep. of Germany ..... 3001446

[51] Int. Cl.[3] ..... E04B 1/38; E04D 1/34; E04D 3/36

[52] U.S. Cl. ..... 52/511; 52/466; 52/543; 52/552; 52/714; 411/461; 411/466

[58] Field of Search ..... 52/267, 275, 311, 506, 52/547, 714, 466, 316, 509, 508, 512, 511, 543, 369, 370, 363, 312, 716; 411/457, 461, 466

[56] References Cited

U.S. PATENT DOCUMENTS

| | | | |
|---|---|---|---|
| 308,312 | 11/1884 | Gardner | 52/716 |
| 761,569 | 5/1904 | Widdop | 411/466 |
| 990,209 | 4/1911 | MacKenzie | 411/461 |
| 1,076,975 | 10/1913 | Goodrow | 52/316 |
| 2,005,895 | 6/1935 | Hengstenberg | 52/511 X |
| 2,066,814 | 1/1937 | Williams | 52/363 |
| 2,180,651 | 11/1939 | Williams | 52/363 |
| 2,831,222 | 4/1958 | Anderson | 52/512 |
| 2,880,472 | 4/1959 | Kublanow | 52/509 X |
| 3,071,827 | 1/1963 | Van Buren, Jr. | 52/511 |
| 3,222,831 | 12/1965 | Pritchard | 52/363 |
| 3,236,016 | 2/1966 | Koenigshof | 52/363 X |
| 3,298,147 | 1/1967 | Haberman | 52/714 X |
| 3,300,924 | 1/1967 | Ashby et al. | 52/275 |
| 3,628,297 | 12/1971 | Richardson | 52/267 |

FOREIGN PATENT DOCUMENTS

| | | | |
|---|---|---|---|
| 636732 | 2/1962 | Canada . | |
| 971726 | 7/1975 | Canada . | |
| 2515624 | 10/1976 | Fed. Rep. of Germany | 52/509 |
| 2757957 | 6/1979 | Fed. Rep. of Germany . | |
| 772576 | 8/1934 | France | 52/506 |
| 824921 | 11/1937 | France | 52/511 |

*Primary Examiner*—Alfred C. Perham
*Attorney, Agent, or Firm*—Spencer & Frank

[57] ABSTRACT

A paneling structure and a retainer for use therewith. The paneling structure is of the overlapping type and has first paneling elements that are spaced farther away from the surface to be paneled and second paneling elements that are closer to that surface. The paneling elements themselves are of wood, plastic or the like. The retainer is appropriately Z-shaped and is provided with an engagement projection and a press-in projection which cooperates with the parts so as to hold the paneling structure together.

7 Claims, 8 Drawing Figures

Figure 4:
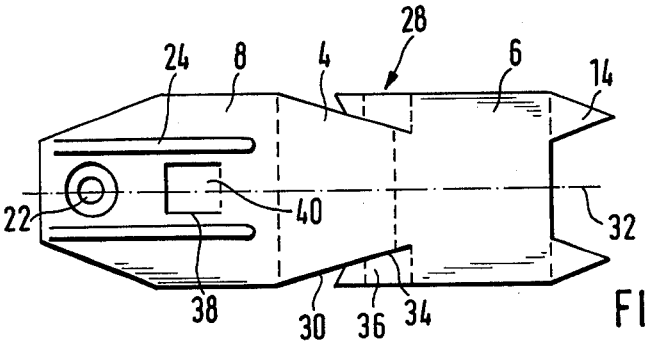

RETAINER FOR THE ATTACHMENT OF PANELING ELEMENTS, PANELING STRUCTURE PRODUCED BY USING THE RETAINER AND PANELING STRIP SUITABLE FOR USE OF THE RETAINER

The invention relates to a retainer for the application of paneling elements of wood, plastic or the like, to a paneling structure produced using the retainer and to a paneling strip which can be applied with the help of the retainer.

The paneling elements are made, for example, of solid wood, wood materials comprising glued together wood blocks or wood layers, compressed materials pressed from wood fibers with the addition of plastic, plastic, in particular polyurethane foam or polyvinyl chloride foam with a closed outer skin, and in the extreme case even of soft metal. At least the visible sides of the paneling elements may, for example, be veneered or plastic coated. From the point of view of shape, the paneling elements may, for example, be board-shaped, plate-shaped, slab-shaped or strip-shaped. The retainer is preferably made of metal, for example steel, which may also be zinc coated. In certain applications, retainers of solid plastic can also be used, particularly if the paneling elements are relatively soft.

The paneling elements are applied, in particular, to ceilings or walls. If the parts to be applied to the surfaces which are to be paneled can be secured thereto by nails, screws, staples or the like and if the high labor costs normally associated therewith are considered to be acceptable, the surfaces which are to be paneled can themselves form the support structure recited in the claims. Normally, however, a separate support structure is provided, for example in the form of laths arranged at a spacing relative to one another, which are doweled to the surfaces to be paneled.

It is an object of the invention to provide a retainer which can be applied quickly and simply to a paneling element.

It is a further object of the invention to provide a retainer which requires no separate fastening means.

It is a further object of the invention to provide a retainer which makes possible an invisible application of the paneling elements to the surface to be paneled.

It is a further object of the invention to provide a retainer which enables a simple and quick application of overlapping paneling. An overlapping paneling is composed of spaced paneling elements which are arranged close to the surface to be paneled, and paneling elements which are further away from the surface to be paneled and which bridge, with overlapping, the spaces between the paneling elements closer to the surface to be paneled.

It is a further object of the invention to provide a paneling structure which can be simply and quickly applied with the aid of the retainer according to the invention.

It is finally an object of the invention to provide an improved paneling strip. This paneling strip is suitable for application with the aid of the retainer according to the invention.

The retainer according to the invention comprises a first connection zone, which has at least one engagement projection and at least one press-in projection, and also a second connection zone. The engagement projection is suitable for insertion into a groove in the rear side of a paneling element and serves the purpose of automatically correctly positioning the retainer during the pressing-in of the press-in projection. When the engagement projection, upon pressing in of the press-in projection, rests against the groove wall facing away from the press-in projection, there is produced an increased security against unintentional release of the retainer from the paneling element, since for release a rotation of the retainer about the position at which the press-in projection is pressed in would have to take place. A still further increased security against inadvertent release of the retainer is provided if care is taken that the engagement projection bodily penetrates into the groove wall upon attachment of the retainer at a paneling element. The pressed-in press-in projection then latches, so to speak, the specially withdrawal resistant securement of the engagement projection in the groove. Examples of such forms of engagement projection are given in the claims and in the description of the preferred embodiments.

Preferably, the press-in projection and/or the engagement projection have a pointed end in order to facilitate their penetration into the material of the paneling elements.

Preferably, the retainer according to the invention has one or two engagement projections and one or two press-in projections. If a plurality of engagement projections and/or a plurality of press-in projections are provided, the features defined in the dependent claims are intended to preferably refer to all relevant projections.

The expressions, "in the direction away from the press-in projection", "in the direction towards the engagement projection" and the like are intended to merely indicate the type of inclined position and not the exact orientation of one projection with reference to the other projection.

The retainer according to the invention is preferably provided with a screw hole in its second connection zone. A stiffening corrugation can be provided at one or both sides, adjacent the screw hole, so as to provide additional space for the heads of incorrectly inserted screws.

In a substantially Z-shaped retainer according to the invention, the angle between the central portion and each of the two shanks [of the Z] may be about 90°. However, obtuse angles in the range of about 90° to 110° are also possible at these points.

Preferably, the entire surface which is to be paneled in the manner according to the invention is paneled with the paneling structure. However, at corners, at projections which are difficult to panel or the like, individual paneling elements must be conventionally applied to the manner customary in the art.

Figure 1:
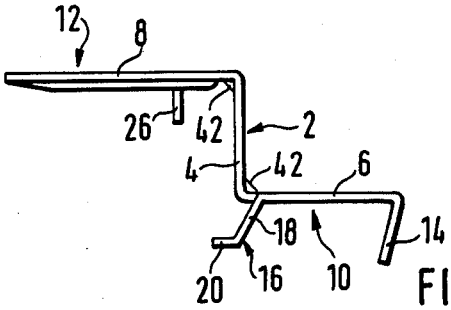
Figure 3:
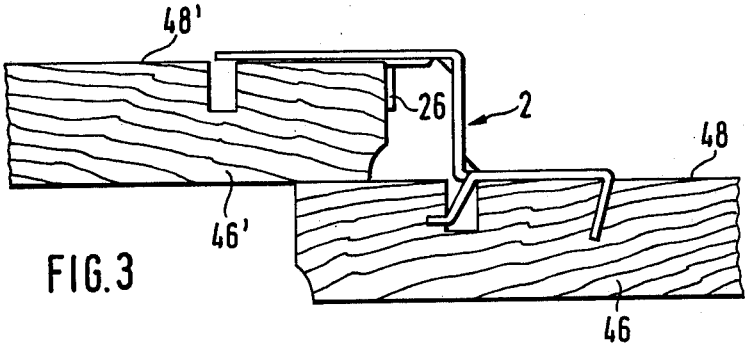
Figure 2:
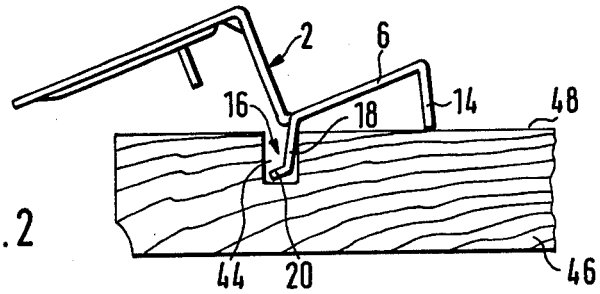
Figure 7:
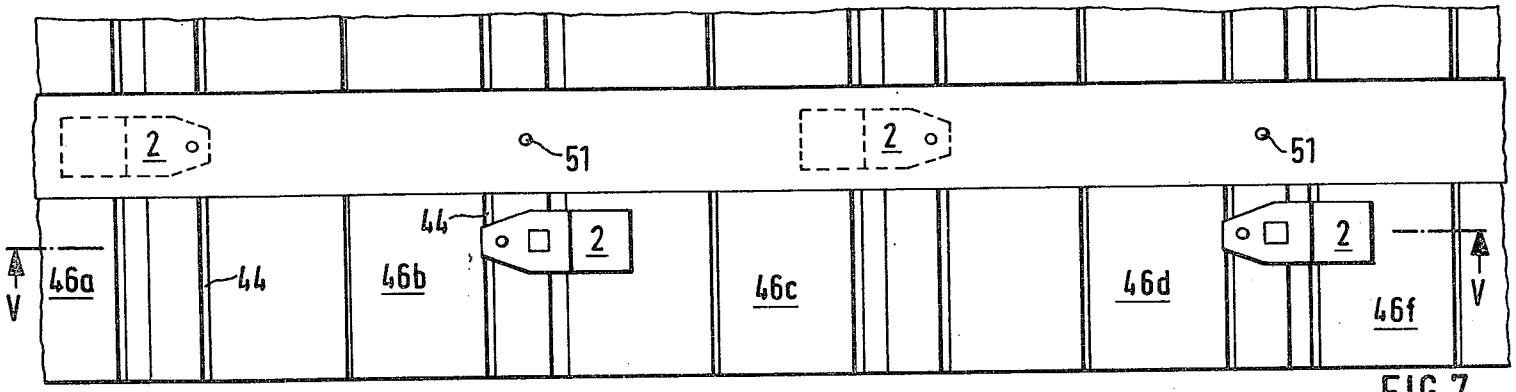
Figure 5:
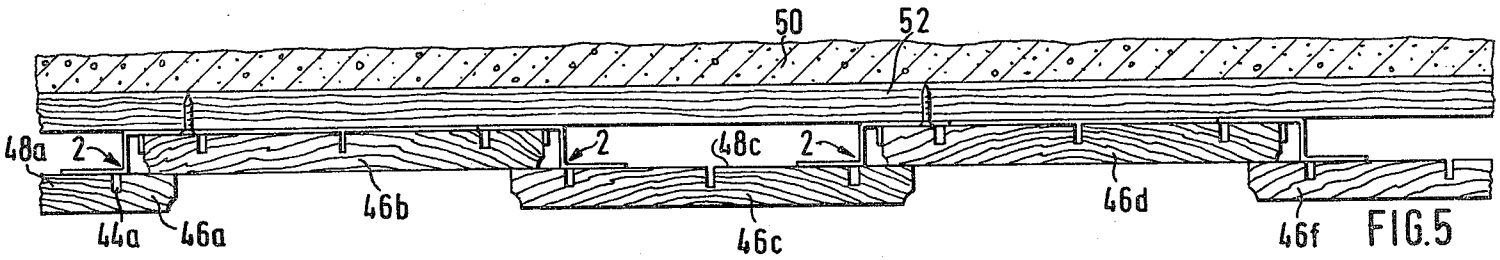
Figure 6:
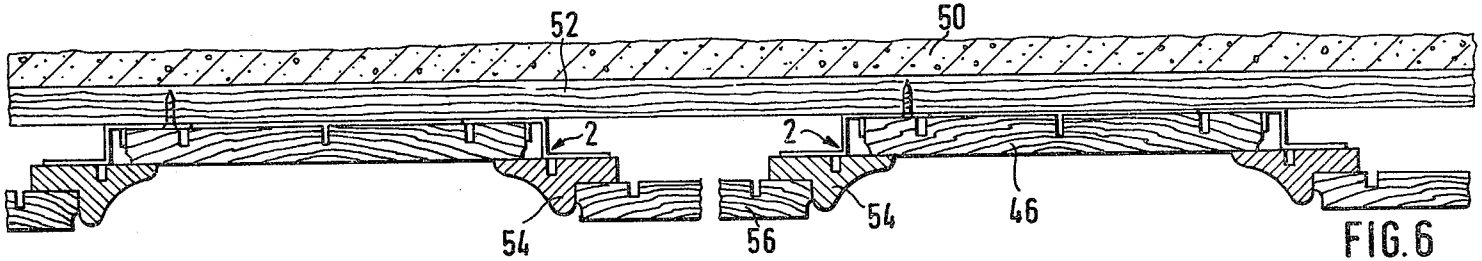
Figure 8:
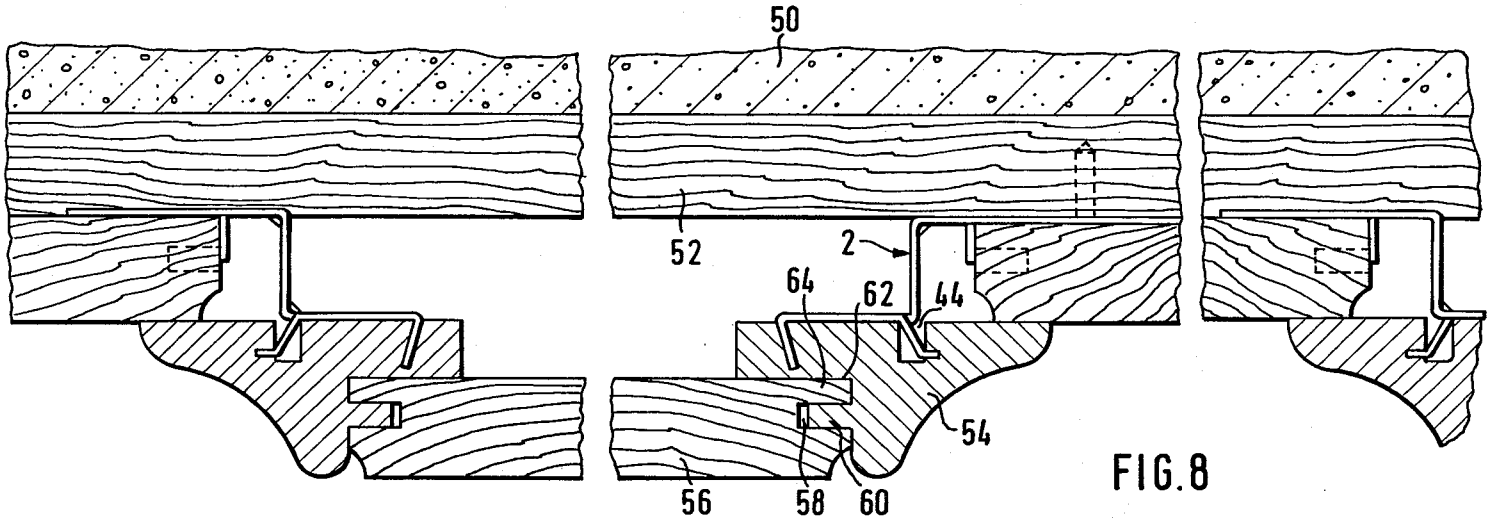

The invention will be described in more detail below with reference to schematic representations of several embodiments. It is shown in:

FIG. 1, a side view of a Z-shaped retainer;

FIG. 2, the retainer accordng to FIG. 1 during insertion of the engagement projection into a fastening groove;

FIG. 3, the retainer according to FIG. 1 with its first connection zone completely fixed to a paneling element;

FIG. 4, a plan view of a stamped blank, from which the retainer according to FIG. 1 can be manufactured by banding at bend lines;

FIG. 5, a sectional view along the line 5—5 of FIG. 7 of an overlapped ceiling paneling using retainers according to FIG. 1 which are represented only schematically;

FIG. 6, an overlapped ceiling paneling similar to FIG. 5, in which, however, the boards more distant from the ceiling are replaced by units each comprising two strips and a board connected thereto;

FIG. 7, a plan view from above, i.e. viewed downwardly from the underside of the ceiling, of the ceiling paneling according to FIG. 5;

FIG. 8, an illustration analogous to FIGS. 5 and 6 of a ceiling paneling similar to FIG. 6 but in more detailed illustration and with a modified connection between the board more distant from the ceiling and the two adjacent strips.

The retainer 2 which can be seen in detail in FIGS. 1 to 3 and 8 has, when seen from the side, essentially the shape of a Z with a central, vertical bar 4 and two shanks 6 and 8 projecting therefrom in the longitudinal direction of the retainer. A first connection zone 10 of the retainer 2 is formed in the region of the shank 6 and a second connection zone 12 is formed in the region of the shank 8.

At the free end of the shank 6 of the retainer, which is lowermost in FIG. 1, two press-in projections 14 are bent downwardly, i.e. away from the bar 4. Viewed from the front of the retainer 2, the press-in projections 14 have pointed ends. In the region of the bar end of the shank 6, two engagement projections 16 are formed by bending downwardly, i.e. away from the bar 4. The engagement projections 16 each comprise an engagement bar 18 extending obliquely from the shank 6 and an engagement end 20 extending parallel to the shank 6 in the direction away from the press-in projections 14. When seen in a view toward the retainer (see also FIG. 4), the engagement ends 20 are pointed. Relatively near its free end, the other shank 8 is provided with a bore 22 which is sunk at the underside of the shank 8 of FIG. 1, i.e. at the side facing the bar 4, and can serve for the insertion of a fastening screw. In the longitudinal direction of the retainer 2, i.e. in the direction from the free end of the shank 6 toward the free end of the shank 8, stiffening corrugations 24 extend at each side of the bore 22 at the underside of the shank 8 and project beyond the remainder of the underside of the shank 8. At a spacing from the bar 4, an abutment projection 26 extends downwardly from the shank 8.

FIG. 4 shows an intermediate stage in the manufacture of the retainer 2. The illustrated blank 28 is stamped from sheet metal and has an outer contour shaped so that the free end of the shank 8 of a subsequently produced blank adjoining the free end of the shank 6 will just fit into the sheet metal region between the subsequent press-in projections 14. In other words, the trapezoidally formed free end of the shank 8 fits exactly between the projections 14 to be manufactured. The press-in projections 14 to be manufactured are triangular when seen in a view toward the blank 28. In its central region, the blank 28, which in plan view is roughly substantially rectangular, has edges 30 which continue as slits and which converge towards the longitudinal center line 32, which is also the line of symmetry. Where these edges 30 turn into the slits 34, tabs 36 are formed which are subsequently bent to form the engagement projections 16. when seen from the top, the free ends of the tabs 36 are pointed. In the region of the subsequent shank 8, a slit 38 is stamped in which describes three sides of a rectangle. If the tab 40 located within this slit 38 is bent through 90°, the abutment projection 26 is produced.

Typical dimensions of the retainer 2 are a width of 20 to 40 mm, a length of shank 8 of 30 to 50 mm, a length of shank 6 of 20 to 30 mm, a height of bar 4 of 11 to 30 mm and a sheet metal thickness of 1 to 2 mm. The engagement projections 16 typically project at an angle of 110° to 130°, measured at the side facing the press-in projections 14, away from the plane of the shank 6. The angle of inclination of the press-in projections 14 relative to the plane of the shank 6 typically is 78° to 80°, measured at the side facing towards the engagement projections 16. The length of the engagement ends 20, measured in the longitudinal direction of the retainer 2, typically is 3 to 5 mm. The press-in projections 14 and the engagement projections 16 typically project downwardly 5 to 10 mm beyond the shank 6. Corner reinforcing corrugations 42 can be seen in the angular region between the bar 4 and the shanks 6 and 8.

FIG. 2 illustrates how the retainer 2 can be inserted into a rear fastening groove 44 of a panel board 46. First, the retainer 2 is positioned in an oblique position so that the engagement bar 18 lies approximately at a right angle to the plane of the board 46 and thus approximately in the direction of the depth of the groove. The engagement ends 20 have a length such that the engagement projections 16, in this pivoted position of the retainer 2, can just yet be lowered into the fastening groove 44. When the engagement projections 16 have been fully lowered into the fastening groove 44, the retainer 2 is pivoted in a direction of rotation such that the shank 6 is positioned parallel to the planar rear surface 48 of the board 46. During this, the press-in projection side of the engagement bar 18 is supported on the upper edge of one groove side wall, so that the engagement ends 20 are automatically pressed into the opposite groove side wall. Initial penetration of the engagement ends 20 can be ensured by a light hammer blow on the free end of the shank 6. During the pivoting of the retainer 2 in the above-described direction of rotation, the press-in projections 14 are also pressed into the rear side 48 of the board 46. During this, the inclined position of the press-in projections 14 ensures that during further pivoting the engagement ends 20 are pressed deeper into the groove side wall. After the completely secure application of the first connection zone 10 of the retainer 2, the end situation, which is particularly clearly visible in FIGS. 3 and 8, is reached, in which the shank 6 lies flush against the rear 48 of the board 46 and the press-in projections 14 and the engagement projections 20 are fully pressed into the wood. Removal of the retainer 2 can take place analogously in the reverse direction.

In the described state of attachment, a space is formed between the second connection zone 12 and the rear side 48 of the board 46, to which the first connection zone is fixed, which space is defined on two sides by substantially parallel surfaces. As can be seen particularly in FIG. 3, a further paneling board 46' can be inserted into this space. The tolerances are chosen so that a tight fit is produced. The insertion can be effected until there is a frontal abutment of the board 46' against the abutment projection 26. The planar rear surface 48' of the board 46' then slides along the corrugations 24, which, on one hand, facilitates insertion and, on the other hand, provides a somewhat larger free space for screw heads which may be positioned somewhat obliquely in the sunk portion of the bore 22. In the above-described manner, the retainer 2 establishes an overlapping connection between two paneling boards 46 and 46', an edge region of the rear side 48 of the board 46 which is spaced farther away from the surface to be paneled overlapping an edge region of the front of the further board 46'. With a sufficiently long shank 8 and a sufficiently long relative overlap, or by means of additional screws between the shank 8 and the board 46', this connection is made substantially rigid.

FIG. 5 shows how the above-described connection principle can be employed in the production of an overlapped ceiling paneling. A wall paneling can be produced analogously. On a room ceiling 50, at a mutual spacing of 50 to 60 cm, laths are secured by dowels or staples. The laths have, for example, a cross section of 2×3 or 3×5 cm. The panel boards 46 extend at right angles to the longitudinal direction of the laths 52. The board **46*a* located furthest to the left in FIG. 5 is a board which is spaced farther from the ceiling lath and thus from the ceiling 50. The right-hand edge of the board 46*a*, as viewed in FIG. 5, is secured to the lath 52 in that a retainer 2 is fastened in the above-described manner with its first connection zone 10 fixed to the rear side 48*a* using the fastening groove 44*a*, and the second connection zone 12 of the retainer 2, oriented to the right in FIG. 5, is attached to the lath 52 by means of a screw or is nailed to the lath. The left-hand edge region, as viewed in FIG. 5, of an adjoining board 46*b* is inserted into the space between the lower side of the shank 8 of this retainer and the rear 48*a*. This board 46*b* thus lies close to the lath 52 and, at its point of insertion, is separated from the lath 52 only by the thickness of the sheet metal of the retainer. The right-hand edge region as viewed in FIG. 5 of the board 46*b* is nailed to the lath 52 at 51, an insert (not shown), for example provided in the form of a clip engaging both sides of the edge of the board, maintaining the same spacing relative to the lath 52 as on the left. The insert may also be omitted. At the left-hand edge region, as viewed in FIG. 5, of the rear side 48*c* of the next adjoining board 46*c* there is fastened, in the above-described manner, a retainer 2 by its engagement projections 16 and its press-in projections 14, but in such a manner that the second connection zone 12 is oriented toward the left, as shown in FIG. 5, i.e. in the opposite direction to the previously described retainer 2. The space remaining between the second connection zone 12 of the last-mentioned retainer 2 and the rear side 48*c* of the board 46*c* is able to accommodate the right-hand side region, as viewed in FIG. 5, of the preceding board 46*b*, the left-hand edge region of the board 46*c* covering the point(s) where board 46*b* is nailed. At the right-hand side region, as viewed in FIG. 5, there is again fastened a retainer 2 analogously to the first-described retainer 2 at the board 46*a*, which retainer is in turn screwed or nailed to the lath 52. From here on, the construction and the fastening of the panel structure is repeated over the entire ceiling 50 which is to be paneled. If the shank 8 of the retainer 2 is sufficiently long and the amount of overlap is sufficiently large or with additional screwing or nailing between the shank 8 and the board, nailing of the right-hand edge regions of the boards 46*b*, 46*d*** can be omitted, since a sufficiently rigid connection is then provided at those points.

Installation can be effected either by firstly inserting only the left-hand side edge, as viewed in FIG. 5, of the board **46*b* into the above-described space, then nailing or screwing the right-hand edge region of the board 46*b* to the lath(s) 52 and then sliding the board 46*c*, to which the two retainers 2 are fixed, with its left-hand side region and the left-hand retainer 2 onto the right-hand side region of the board 46*b*. Or the boards 46*b* and 46*c* can first be assembled into a unit by means of the retainer 2 located between them and this unit as a whole can then be slid partway into the space between the right side region of the board 46*a* and the associated retainer 2. Then the right-hand retainer 2 of the board 46*c* is screwed to the lath 52. It must be pointed out that the use of a screw at the second connection zone 12 of the retainer 2 at the transition between the boards 46*b* and 46*c* is not essential, but is possible in the second above-described installation procedure. It can be seen in FIG. 5 that in the illustrated ceiling paneling boards, such as the boards 46*b* and 46*d*, which lie closely against the laths 52 alternate with boards, such as the boards 46*a* and 46*c*, whose rear sides are spaced from the lath 52** by approximately the thickness of one board.

In FIG. 7, it can be seen that the retainers screwed to the lath 52—viewed in the longitudinal direction of the boards 46—obviously lie at positions beneath the lath 52, while the retainers 2 which are not screwed to the laths 52 may lie adjacent the lath 52, which facilites installation.

Typically, the boards are 10 to 20 cm wide and have a length corresponding to the dimensions of the ceiling; lengths up to six meters or even more can be applied without difficulty. Typically, the boards are 14 to 24 mm thick. Viewed in the longitudinal direction of the boards, the retainers 2 are normally provided at a mutual spacing of 50 to 60 cm, corresponding to the lath spacing. The boards may be made, for example, of solid wood or chipboard material. Plastic paneling elements in board shape, for example of polyurethane foam, are also possible.

The rear sides of the boards are provided with fastening grooves 44 extending parallel to their longitudinal edges and, although they are in the edge regions, they are spaced, for example, 15 to 30 mm from the edge. In the middle of each of the rear sides 48 of the boards 46 there is provided a so-called warp groove. The length of overlap between the individual boards 46, viewed in the longitudinal direction of the lath 52, is about 10 to 15 mm. This is where relative displacement of the boards takes place in order to compensate for expansion or shrinkage. For reasons of clarity, the engagement projections 16 and the press-in projections 14 are not illustrated in FIGS. 5 and 6.

The panel structure according to FIG. 6 differs from that shown in FIG. 5 only in that there is provided, instead of the boards **46*a*, 46*c* and 46*f*, which are spaced farther away from the lath 52, an interconnected unit of two strips 54 extending in the longitudinal direction of the boards 46 with a bridging board 46 arranged therebetween. The bridging board 56, which may, for example, be of the same design as a board 46, has its lateral rear corners glued into corresponding angularly profiled spaces in the strips 54. This design has the advantage that the bridging board 56 has a greater distance from the lath 52 than was the case in the embodiment according to FIG. 5 for the boards 46*a*, 46*c* and 46*f***. Thus, almost without additional weight, there is produced a more distinctly profiled and structured ceiling paneling appearance, with the bridging boards appearing almost like ceiling beams.

FIG. 8 shows, to an enlarged scale, a paneling structure corresponding substantially to that of FIG. 6, in which, however, the bridging boards 56 are provided in each of their longitudinal side edges with a longitudinal groove 58 into which engages a complementary longitudinal projection 60 of the associated strip 54. Between the projection 60 and the rear base of the strip 54, there is thus produced a longitudinal groove 62 in the strip 54, into which engages a complementary longitudinal projection 64 of the bridging board 56. Thus, a rigid, double tongue and groove connection is produced between the bridging board 56 and the two adjoining strips 54. Additionally, glue may be used there, since a particularly large gluing surface is available.

At their visible side, the strips 54 may have an attractive, rounded contour. They may be made of solid wood or may be veneered like the boards 46 and 56. The rear sides of the strips 54 shown in FIGS. 6 and 8 have, on their rear side, only one fastening groove 54 which extends in the longitudinal direction.

The preceding description has shown that the first connection zone 10 of the retainer 2 according to the invention is secured to the paneling element in a form-locking manner, particularly by the engagement ends 20, and particularly in the direction perpendicular to the rear side of the paneling element, the press-in projections 14 providing increased security against sliding out of the engagement ends 20. The connection zones 10, 12 and the shanks 6, 8 are preferably planar. The press-in projections 14 can be driven into the rear of the paneling elements by means of hammer blows.

The overlapping paneling structure illustrated in FIG. 5 can be modified to a paneling structure with panel boards 46 lying in one plane by employing, instead of the Z-shaped retainers 2, substantially planar retainers having only the above-described projections. The above-described manner of installation remains the same, although of course in the second manner of installation, the retainer located between the boards **46*b* and 46*c* must be screwed or nailed to the board 46*b***.

It is emphasized that by means of the retainer according to the invention, an application of paneling is possible in which the mounting of the paneling is not visible at all and no annoying gaps appear even if the paneling elements shrink, as is clearly demonstrated by the illustrated embodiments.

In the embodiments according to FIGS. 6 and 8, it is of advantage that only the strips 54 are held directly by retainers 2. This advantage becomes particularly significant when the flat paneling elements 46 and 56, described previously as boards, are made of a comparatively soft material, for example veneered compressed wood fiber material. In that case, it is sufficient to select the strips 54 of a more solid material, for example veneered solid wood, since the retainers 2 engage particularly securely in the more solid material.

I claim:

1. A paneling structure, including paneling elements of wood, plastic or the like, of the overlapping arrangement type, comprising elongated first paneling elements spaced farther away from the surface to be paneled and elongated second paneling elements closer to the surface to be paneled, said paneling elements having first and opposite second edge regions and being supported by a supporting structure in such a manner that first edge regions of said second paneling elements are adjacent to second edge regions of said first paneling elements and that second edge regions of said second paneling elements are adjacent to first edge regions of said first paneling elements, wherein:

(a) at least said first paneling elements comprising at their rear surfaces at least first and second longitudinally extending grooves having two walls, each of said first grooves being provided at a respective said first edge region and each of said second grooves being provided at a respective said second edge region;

(b) a plurality of substantially Z-shaped retainers, each having a first shank, a second shank and a central bar connecting said first and said second shank, are attached in spaced relationship along said first and second edge regions to the said rear surfaces of said first paneling elements such that said second shanks are directed towards adjacent said second paneling elements;

(c) said retainers comprise at their respective said first shank at least one engagement projection having an engagement end which is penetrated into one of said walls of one of the said grooves, as well as at least one press-in projection, which is pressed to the respective said rear surface at a distance from the said one of said grooves;

(d) pairs of one of said first paneling elements and of an adjacent one of said second paneling elements, which is fitted with its said second edge region into the space between said rear surface of said one of said first paneling elements and said second shanks of those of said retainers attached to the said first edge region of said one of said first paneling elements, are secured to said supporting structure by fitting said one of said second paneling elements with its first edge region into the space between said rear surface of an oppositely adjacent one of said first paneling elements and said second shanks of those of said retainers attached to the said second edge region of said oppositely adjacent one of said paneling elements and by securing said second edge region of said one of said first paneling elements to said supporting structure by means of those of said retainers attached thereto.

2. A paneling structure according to claim 1, wherein said pairs of one of said first paneling elements and of an adjacent one of said second paneling elements are additionally secured to said supporting structure by fixing said second edge region of said one of said second paneling elements to said supporting structure.

3. A paneling structure according to claim 1 or 2, wherein said first paneling elements are each formed of two spaced paneling strips and by a bridging element which connects the two paneling strips, said first and second grooves being provided at the rear surfaces of said paneling strips.

4. A retainer for holding a paneling element of wood, plastic or the like of a paneling structure in place, the paneling structure being of the overlapping arrangement type comprising first paneling elements spaced farther away from the surface to be paneled and second paneling elements closer to the surface to be paneled, and the retainer being adapted to be used in mounting one of said first paneling elements, which comprises at its rear surface at least two longitudinally extending grooves having two walls, to an adjacent one of said second paneling elements or to a supporting structure of the said paneling structure, wherein (a) said retainer is substantially Z-shaped and has a first shank, a second shank and a central bar connecting said first and said second shank;

(b) said first shank comprising at least one engagement projection with an engagement end, which is adapted to penetrate into one of the said two walls of one of the said grooves of said first paneling element, as well as at least one press-in projection, which is spaced from the said engagement projection in the longitudinal direction of said first shank and which is adapted to be pressed into said rear surface of said first paneling element at a distance from said one of the said grooves;

(c) said central bar having such a dimension that one of said second paneling elements may be fitted into the space between the said second shank and the said rear surface of the said first paneling element, when the said retainer is attached to said first paneling element by means of its said engagement projection and its said press-in projection;

(d) said engagement projection comprising an engagement bar projecting from said first shank and said engagement end forming an angle with said engagement bar in the direction away from the said press-in projection;

(e) said engagement bar projecting obliquely from said first shank in the direction away from said press-in projection and the angle of inclination of said engagement bar and the length of the said engagement end being adapted to the distance between said walls of said one groove in such a way that said engagement end penetrates into said one of the said two groove walls upon pivoted insertion of said engagement projection into said one groove and due to said engagement bar being supported on the other one of said two groove walls.

5. A retainer for holding a paneling element of wood, plastic or the like of a paneling structure in place, the paneling structure being of the overlapping arrangement type comprising first paneling elements spaced farther away from the surface to be paneled and second paneling elements closer to the surface to be paneled, and the retainer being adapted to be used in mounting one of said first paneling elements, which comprises at its rear surface at least two longitudinally extending grooves having two walls, to an adjacent one of said second paneling elements or to a supporting structure of the said paneling structure, wherein (a) said retainer is substantially Z-shaped and has a first shank, a second shank and a central bar connecting said first and said second shank;

(b) said first shank comprising at least one engagement projection with an engagement end, which is adapted to penetrate into one of the said two walls of one of the said grooves of said first paneling element, as well as at least one press-in projection, which is spaced from the said engagement projection in the longitudinal direction of said first shank and which is adapted to be pressed into said rear surface of said first paneling element at a distance from said one of the said grooves;

(c) said central bar having such a dimension that one of said second paneling elements may be fitted into the space between the said second shank and the said rear surface of the said first paneling element, when the said retainer is attached to said first paneling element by means of its said engagement projection and its said press-in projection;

(d) said press-in projection projecting obliquely from said first shank in the direction toward said engagement projection.

6. A retainer according to claim 4 or 5, wherein an abutment projection is provided on said second shank.

7. A retainer according to claim 4 or 5 the same being a member stamped out of sheet metal, said press-in projection, said engagement projection and said abutment projection being formed by the bending of sheet metal zones.

* * * * *